US010926934B2

(12) United States Patent
Buelna

(10) Patent No.: US 10,926,934 B2
(45) Date of Patent: Feb. 23, 2021

(54) UNITIZED PACKAGING SUSPENSION SYSTEM

(71) Applicant: Edward S. Buelna, San Jose, CA (US)

(72) Inventor: Edward S. Buelna, San Jose, CA (US)

(73) Assignee: FRINGENIUS, San Jose, CA (US)

( * ) Notice: Subject to any disclaimer, the term of this patent is extended or adjusted under 35 U.S.C. 154(b) by 0 days.

(21) Appl. No.: 16/140,199

(22) Filed: Sep. 24, 2018

(65) Prior Publication Data

US 2019/0092549 A1 Mar. 28, 2019

Related U.S. Application Data

(60) Provisional application No. 62/562,252, filed on Sep. 22, 2017.

(51) Int. Cl.

| | |
|---|---|
| ***B65D 81/05*** | (2006.01) |
| ***B65D 81/127*** | (2006.01) |
| ***B65D 77/26*** | (2006.01) |
| *B31D 5/00* | (2017.01) |

(52) U.S. Cl.

CPC ..... *B65D 81/052* (2013.01); *B65D 77/26* (2013.01); *B65D 81/127* (2013.01); *B31D 5/0073* (2013.01); *B65D 2581/055* (2013.01)

(58) Field of Classification Search

CPC .... B65D 81/052; B65D 81/051; B65D 77/26; B65D 81/127; B65D 81/133; B65D 2581/055; B65D 25/10; B31B 5/0073

USPC ..... 206/522; 137/231; 141/383; 285/9.1

See application file for complete search history.

(56) References Cited

U.S. PATENT DOCUMENTS

| | | | | |
|---|---|---|---|---|
| 4,905,835 | A * | 3/1990 | Pivert | B65D 81/052 206/522 |
| 5,180,060 | A * | 1/1993 | Forti | B65D 81/052 206/522 |
| 5,769,232 | A * | 6/1998 | Cash | B65D 81/052 206/522 |
| 5,806,683 | A * | 9/1998 | Gale | B65D 81/025 206/587 |
| 6,382,450 | B1 * | 5/2002 | De Rosa | B65D 41/02 206/818 |
| 6,431,361 | B1 * | 8/2002 | Wolf | B65D 81/052 206/522 |
| 7,913,847 | B2 * | 3/2011 | Kasboske | B65D 81/052 206/522 |
| 8,281,928 | B2 * | 10/2012 | Smith | B65D 81/052 206/522 |
| 9,637,296 | B1 * | 5/2017 | Corvisier | B65D 81/052 |
| 2008/0251408 | A1 | 10/2008 | Kasboske | |
| 2014/0319018 | A1 | 10/2014 | Collison | |

* cited by examiner

*Primary Examiner* — Steven A. Reynolds

(57) ABSTRACT

A cushioning apparatus configured to be placed inside of a shipping container includes a plurality of inflation chambers. Each of the chambers is characterized as having a general shape, when inflated, of a truncated rectangular pyramid. Each of the plurality of inflation chambers is foldably coupled to another of the plurality of inflation chambers at an edge of said inflation chamber. The plurality of inflation chambers, when inflated, are configured to be folded into a shape that surrounds a void between said plurality of inflation chambers. There may be six inflation chambers.

17 Claims, 9 Drawing Sheets

UNITIZED PACKAGING SUSPENSION SYSTEM

RELATED APPLICATION

This application claims priority to U.S. Provisional Application No. 62/562,252, filed Sep. 22, 2017, which is hereby incorporated herein by reference in its entirety.

FIELD OF INVENTION

Embodiments of the present invention relate to the field of package cushioning. More specifically, embodiments of the present invention relate to systems and methods for unitized packaging suspension systems.

BACKGROUND

Improvements in packaging of items for shipment, including improvements in shock absorption, and improvements in a packaging process are sought.

SUMMARY OF THE INVENTION

Therefore, what is needed are systems and methods for unitized packaging suspension systems. An additional need exists for systems and methods for unitized packaging suspension systems that improve shock protection for a packaged item. What is further needed are systems and methods for unitized packaging suspension systems that reduce packaging parts counts and manual packaging operations. A still further need exists for systems and methods for unitized packaging suspension systems that are compatible and complementary with existing systems and methods of packaging and shipping. Embodiments of the present invention provide these advantages.

In accordance with a first embodiment of the present invention, a cushioning apparatus configured to be placed inside of a shipping container includes a plurality of inflation chambers. Each of the chambers is characterized as having a general shape, when inflated, of a truncated rectangular pyramid. Each of the plurality of inflation chambers is foldably coupled to another of the plurality of inflation chambers at an edge of the inflation chamber. The plurality of inflation chambers, when inflated, are configured to be folded into a shape that surrounds a void between the plurality of inflation chambers. There may be six inflation chambers.

In accordance with another embodiment of the present invention, a cushioning apparatus configured to be placed inside of a shipping container, includes a plurality of truncated rectangular pyramids formed from sheet material. Each of the truncated rectangular pyramids is foldably coupled to another of the plurality of truncated rectangular pyramids at an edge. The plurality of truncated rectangular pyramids are configured to be folded into a shape that surrounds a void between the plurality of truncated rectangular pyramids.

In accordance with a further embodiment of the present invention, a shipping box includes a unitized packaging suspension system. The system includes a plurality of inflated air pillows. Each of the air pillows is characterized as having a general shape of a truncated rectangular pyramid. Each of the plurality of air pillows is foldably coupled to another of the plurality of air pillows at an edge of the air pillows. The plurality of air pillows are folded into a shape that surrounds a void between the plurality of inflation chambers. The shipping box further includes a protected item encapsulated within the void.

BRIEF DESCRIPTION OF THE DRAWINGS

The accompanying drawings, which are incorporated in and form an integral part of this specification, illustrate embodiments of the invention and, together with the description, serve to explain the principles of the invention. Unless otherwise noted, the drawings are not drawn to scale.

DETAILED DESCRIPTION

Figure 1A:
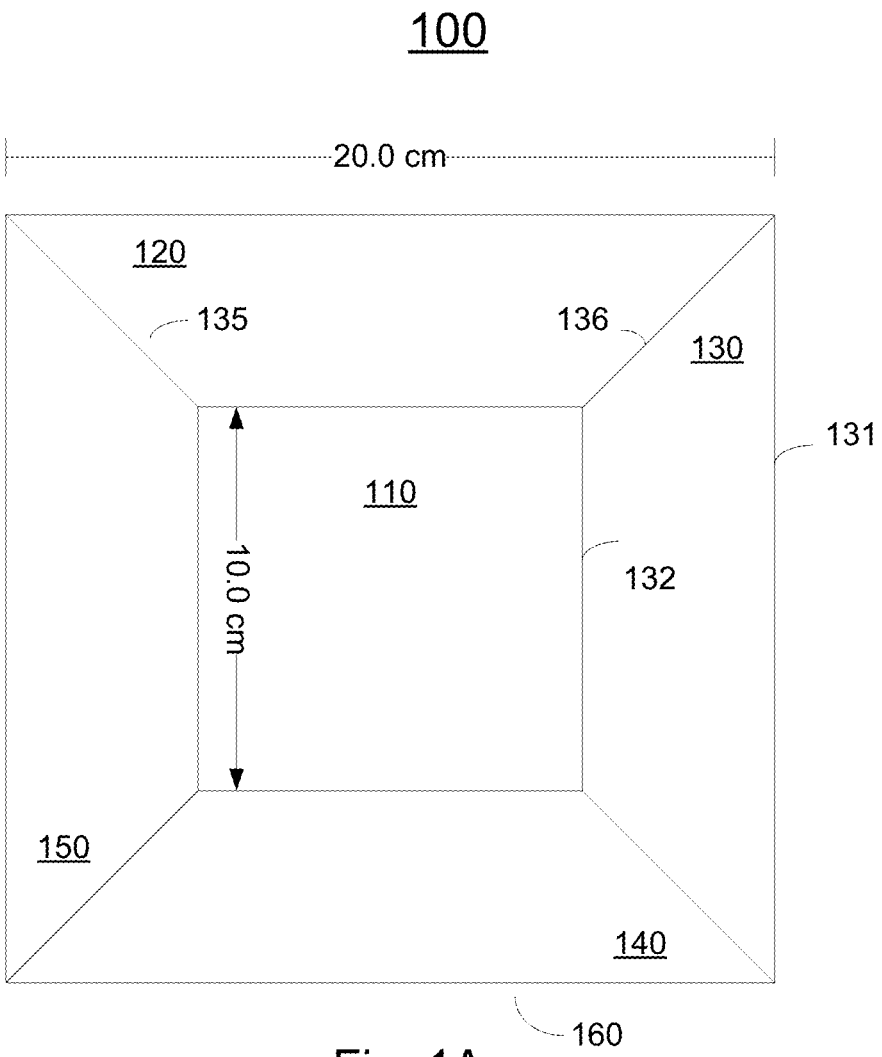
FIG. 1A illustrates an exemplary schematic plan view of a unit of an exemplary unitized packaging suspension system, in accordance with embodiments of the present invention.

Reference will now be made in detail to various embodiments of the present invention, examples of which are illustrated in the accompanying drawings. While the invention will be described in conjunction with these embodiments, it is understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the invention, numerous specific details are set forth in order to provide a thorough understanding of the invention. However, it will be recognized by one of ordinary skill in the art that the invention may be practiced without these specific details. In other instances, well known methods, procedures, components, and circuits have not been described in detail as not to unnecessarily obscure aspects of the invention.

NOTATION AND NOMENCLATURE

Some portions of the detailed descriptions which follow (e.g., method) are presented in terms of procedures, steps, logic blocks, processing, and other symbolic representations of operations on data bits that may be performed on computer memory. These descriptions and representations are the means used by those skilled in the data processing arts to most effectively convey the substance of their work to others skilled in the art. A procedure, computer executed step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, data, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "accessing" or "identifying" or "warping" or "determining" or "displaying" or "damping" or "computing" or "sending" or "receiving" or "reducing" or "detecting" or "setting" or "placing" or "accelerating" or "forming" or "mounting" or "removing" or "ceasing" or "stopping" or "slicing" or "processing" or "performing" or "generating" or "adjusting" or "creating" or "executing" or "continuing" or "applying" or "translating" or "calculating" or "measuring" or "gathering" or "running" or the like, refer to the action and processes of, or under the control of, a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The meaning of "non-transitory computer-readable medium" should be construed to exclude only those types of transitory computer-readable media which were found to fall outside the scope of patentable subject matter under 35 U.S.C. § 101 in In re Nuijten, 500 F.3d 1346, 1356-57 (Fed. Cir. 2007). The use of this term is to be understood to remove only propagating transitory signals per se from the claim scope and does not relinquish rights to all standard computer-readable media that are not only propagating transitory signals per se.

UNITIZED PACKAGING SUSPENSION SYSTEM

FIG. 1A illustrates an exemplary schematic plan view of a unit, or element, 100 of an exemplary unitized packaging suspension system, in accordance with embodiments of the present invention. The indicated dimensions are exemplary. Both smaller and larger sizes, for example, pallet-sized, e.g., a long edge dimension on the order of 40 inches, are well-suited to embodiments in accordance with the present invention. Unit 100 may be combined with other similar units to form a complete unitized packaging suspension system.

Exemplary unit 100 is a three-dimensional structure resembling a truncated square or rectangular pyramid. The thickness of material is not illustrated in the Figures. Face 110, which may be thought of as the "top" of unit 100, is closest to the observer, above the plane of the page in the view of FIG. 1A. Sides 120, 130, 140, and 150 are generally trapezoids. Sides 120, 130, 140, and 150 may be isosceles trapezoids, in some embodiments. Sides 120, 130, 140, and 150 comprise a long edge, e.g., edge 131, a short edge parallel to the long edge, e.g., edge 132, and two "diagonal edges," e.g., edges 135 and 136. The "short edges" 132 may or may not be shorter than one or both diagonal edges 135, 136.

Sides 120, 130, 140, and 150 extend from respective edges of face 110 downward at an acute angle to a base "plane," for example, the plane of the page in the view of FIG. 1A. In some embodiments, sides 120, 130, 140, and 150 may form a 45 degree angle to face 110 and the base plane. Thus, the long edges, e.g., edge 131, of sides 120, 130, 140, and 150 are in a base plane, while the shorter parallel edges, e.g., edge 132, of sides 120, 130, 140, and 150, meet the plane of face 110. All sides 120, 130, 140, and 150 may not be physically connected to face 110. For example, sides 120 and 140 may abut face 110, while not being physically connected together. All sides 120, 130, 140, and 150 may not be physically connected to all adjacent sides. For example, side 120 may abut side 130 along diagonal edge 136, while not being physically connected together.

In some embodiments there may be a base member, e.g., in the plane of the page, below the face 110, abutting the long edges of sides 120, 130, 140, and 150. Such a member, if present, is obscured in the view of FIG. 1A.

Unit 100 may be any suitable shape, and is not limited to the illustrated exemplary truncated pyramid, in accordance with embodiments of the present invention. For example, unit 100 may be a truncated cone or truncated ellipsoidal cone, e.g., a general solid of decreasing diameter(s) having an ellipsoidal cross section. Unit 100 may have other polygonal cross sections, as well.

Figure 1B:
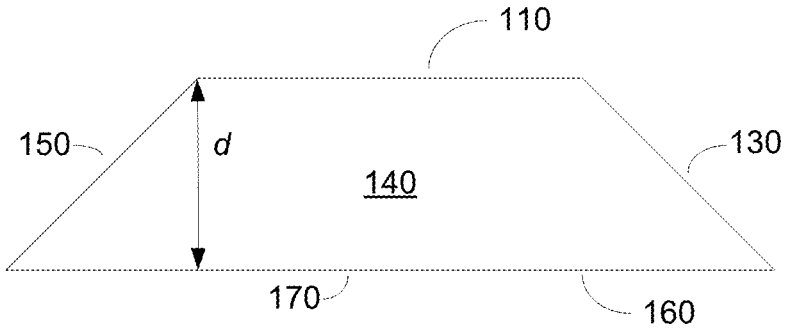
FIG. 1B illustrates an exemplary schematic side view of a unit of an exemplary unitized packaging suspension system, in accordance with embodiments of the present invention.

FIG. 1B illustrates an exemplary schematic side view of a unit 100 of an exemplary unitized packaging suspension system, in accordance with embodiments of the present invention. FIG. 1B illustrates unit 100 rotated 90 degrees from the view of FIG. 1A. In the view of FIG. 1B, unit 100 has a height of a'.

Reference 160 identifies the long edge of face 140 of unit 100. In some embodiments, a base member 170 may be present.

Figure 2A:
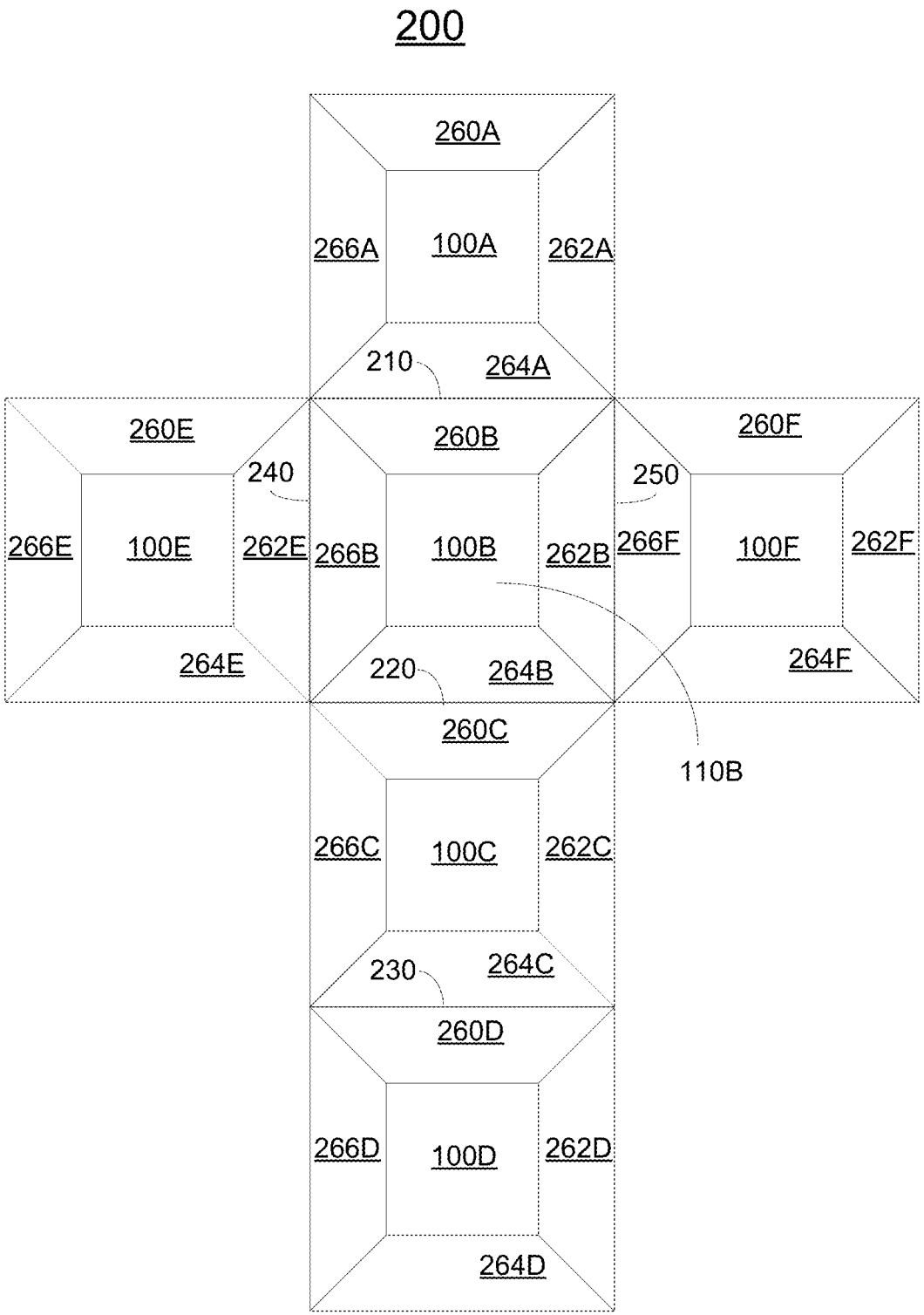
FIG. 2A illustrates an exemplary schematic plan view of an exemplary unitized packaging suspension system, in accordance with embodiments of the present invention.

FIG. 2A illustrates an exemplary schematic plan view of an exemplary unitized packaging suspension system 200, in accordance with embodiments of the present invention. Unitized packaging suspension system 200 comprises six instances of unit 100, instance 100A, 100B, 100C, 100D, 100E, and 100F. For example, unit 100B has a face 110B, corresponding to face 110 of unit 100, as illustrated in FIG. 1A. Unit 100A is attached to unit 100B at joining 210. Unit 100B is attached to unit 100C at joining 220. Unit 100C is attached to unit 100D at joining 230, for example, a "live" hinge. Unit 100B is attached to unit 100E at joining 240. Unit 100B is attached to unit 100F at joining 250. Instances 100A, 100B, 100C, 100D, 100E, and 100F may be formed as a unitary entity, e.g., formed from a single piece of material, in some embodiments. Although illustrated as substantially identical, each unit of exemplary unitized packaging suspension system 200 may be different, in accordance with embodiments of the present invention. For example, the shape of a top face of instances 100A, 100B, 100C, 100D, 100E, and 100F may be different from one another. In addition, some or all bottom edges of instances 100A, 100B, 100C, 100D, 100E, and 100F may have different dimensions from one another, including within a same instance.

Unitized packaging suspension system 200 may comprise any suitable material(s), including, for example, foamed plastic, e.g., polystyrene foam, open or closed foams, plastic, including petroleum, soy and/or corn-based plastic, polyvinyl chloride (PVC), molded pulp paper, e.g., paper mache, paper, card stock, paperboard, folding carton, corrugated fiberboard, wax-coated and/or wax-stiffened paper, and the like. Unitized packaging suspension system 200 may start as a flat sheet, e.g., of cardboard or plastic, and be pressed and/or cut into its desired three-dimensional shape. Alternatively, unitized packaging suspension system 200 may be formed into its final shape in a single operation, e.g., by drying a slurry on a form. Unitized packaging suspension system 200 may be injection molded or blow molded, in some embodiments.

In some embodiments, unitized packaging suspension system 200 may comprise inflatable air cushions, also known as pillows or bags. Such pillows are typically formed from two thin plastic films that are sealed together in certain locations such that, when inflated with a fluid, e.g., a gas or a liquid, a chamber is filled, giving the bag a shape. It is appreciated that such bags usually include an inflation mechanism, typically comprising a one-way valve. It is to be appreciated that such inflatable embodiments will typically not have a shape exactly described by planar surfaces. Rather, such shapes, when inflated, may approximate or resemble a rectangular truncated pyramid.

Unitized packaging suspension system 200 is configured to be folded at each of joinings 210, 220, 230, 240, and 250, such that corresponding faces abut one another. When so folded, face 264A of unit 100A abuts face 260B of unit 100B. Face 264B of unit 100B abuts face 260C of unit 100C. Face 264C of unit 100C abuts face 260D of unit 100D. Face 260A of unit 100A abuts face 264D of unit 100D. Face 266F of Unit 100F abuts face 262B of unit 100B. Face 262E of unit 100E abuts face 266B of unit 100B.

Similarly, face 264F of unit 100C abuts face 262C of unit 100C. Face 264E of unite 100E abuts face 266C of unit 100C. Face 262F of unit 100F abuts face 262D of unit 100D. Face 266E of unite 100 # abuts face 266D of unit 100D. Face 260F of unit 100F abuts face 262A of unit 100A. Face 266A of unit 100A abuts face 260E of unit 100E.

Figure 2B:
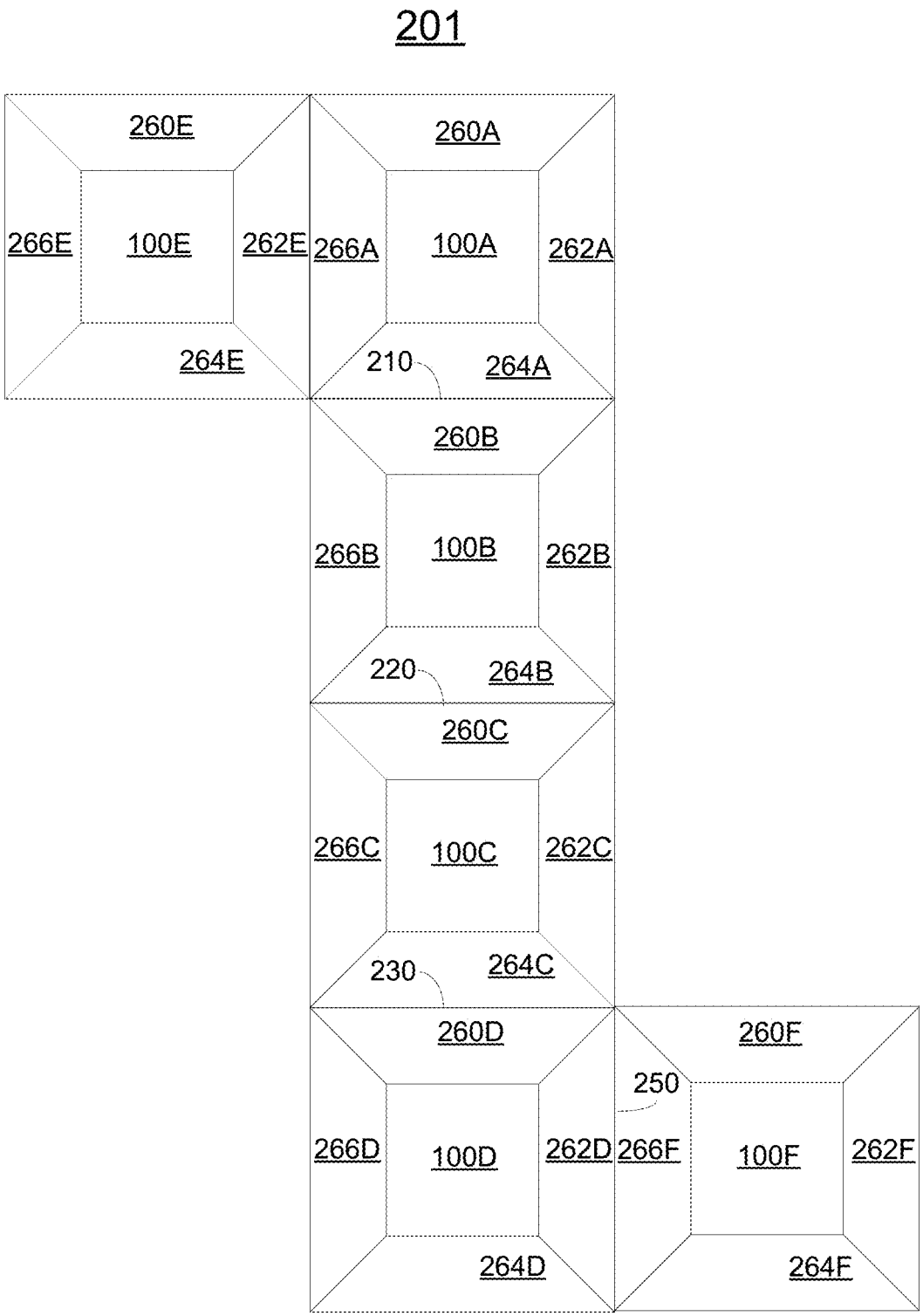
FIG. 2B illustrates an exemplary alternative shape of a unitized packaging suspension system, in accordance with embodiments of the present invention.

While unitized packaging suspension system 200 may be characterized as having a cruciform shape, other shapes of a unitized packaging suspension system are possible, and are to be considered within the scope of the present invention. For example, FIG. 2B illustrates an exemplary alternative shape of a unitized packaging suspension system 201, in accordance with embodiments of the present invention. Unitized packaging suspension system 201 may also be folded into a shape such that corresponding faces abut one another.

Figure 3:
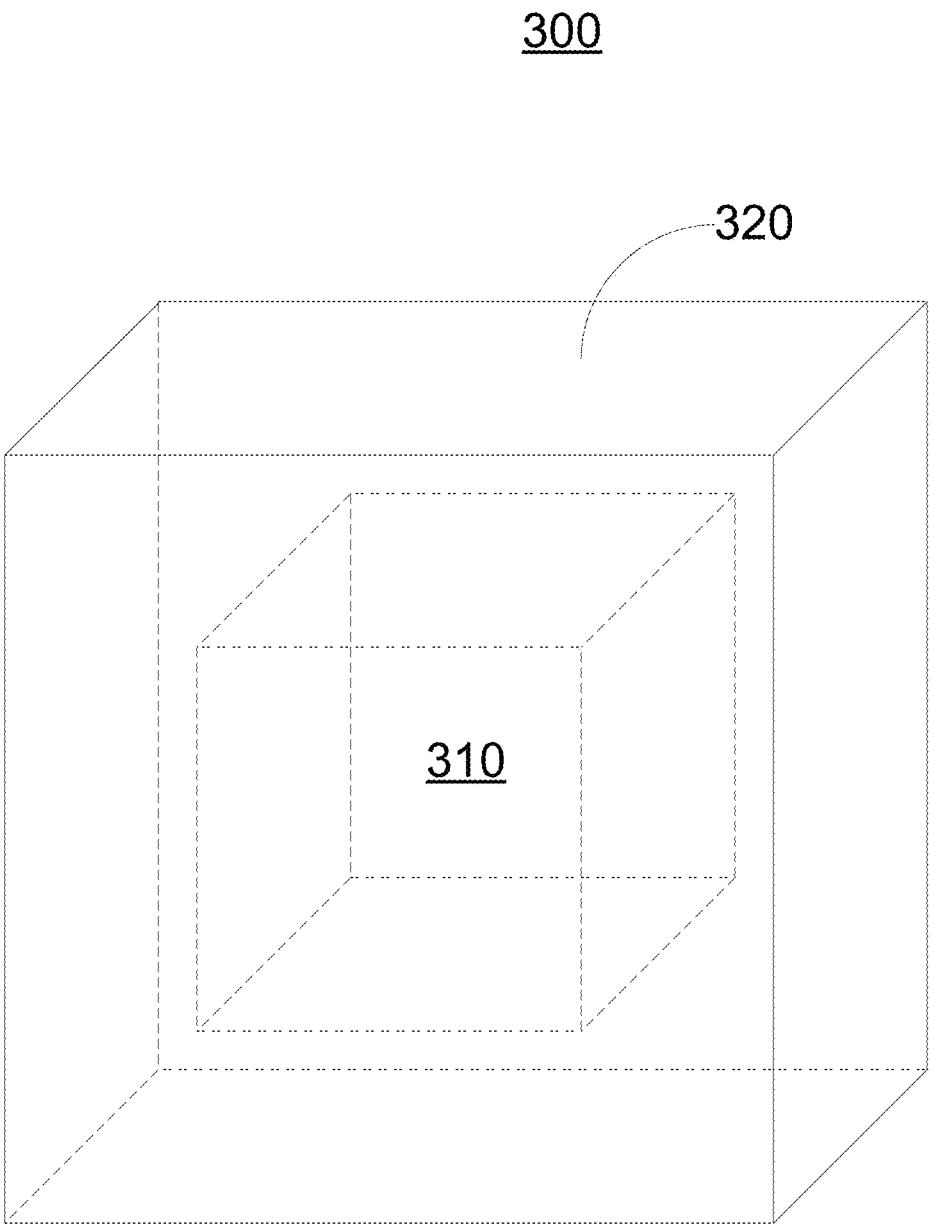
FIG. 3 illustrates an exemplary schematic orthographic projection of an exemplary folded unitized packaging suspension system, in accordance with embodiments of the present invention.

FIG. 3 illustrates an exemplary schematic orthographic projection of an exemplary folded unitized packaging suspension system 300, in accordance with embodiments of the present invention.

Exemplary folded unitized packaging suspension system 300 is formed by "nesting" six instances of unit structures 100 (FIG. 1A) together. Exemplary folded unitized packaging suspension system 300 may be the result of folding exemplary unitized packaging suspension system 200, as previously described. The diagonal edges of the unit structures 100 (FIG. 1A), e.g., diagonal edges 135, 136, are not shown for clarity.

Exemplary folded unitized packaging suspension system 300 may be thought of as a "box within a box." For example, 320 may be considered as an c "outer box," while 310 may be considered as in "inner box," or parallelepiped. However, it is to be appreciated that 310 is actually a void within exemplary folded unitized packaging suspension system 300. For example, using the exemplary dimensions of FIG. 1A, void 310 is a cube of 10.0 cm per side. Further, as previously presented, while unit structure 100 (FIG. 1A) may generally be described as a truncated rectangular pyramid, unit structure 100 may or may not have a base. Consequently, the outer "faces" of "outer box" 320 may not be present.

Figure 4:
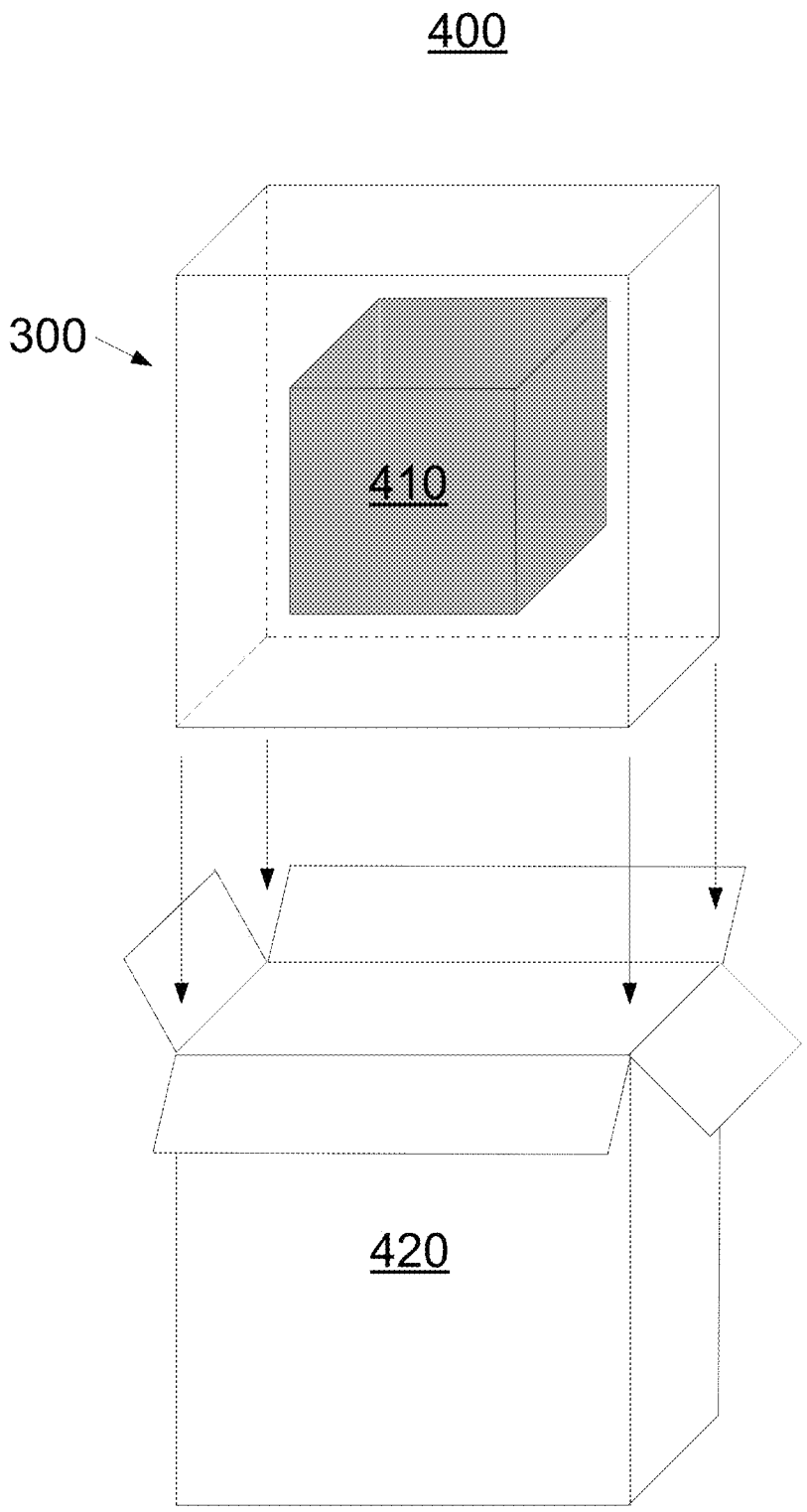
FIG. 4 illustrates an exemplary schematic of an application of an exemplary folded unitized packaging suspension system, in accordance with embodiments of the present invention.

FIG. 4 illustrates an exemplary schematic of an application 400 of an exemplary folded unitized packaging suspension system 300, in accordance with embodiments of the present invention. An item to be protected during shipping, e.g., a "protected item" 410 is enclosed within the void 310 (FIG. 3). For example, protected item 410 may be placed on face 110B of unit 100B (FIG. 2). It is to be appreciated that protected item 410 may be placed in, for example, a "pretty box" prior to being placed on or within the unitized packaging suspension system, but that is not required. For example, protected item 410 may not require an "inner" package, e.g., for aesthetics and/or shipping protection. For example, an engine block may not include an "inner package."

Exemplary unitized packaging suspension system 200 (FIG. 2) may be folded and/or inflated around item 410, forming exemplary folded unitized packaging suspension system 300, as illustrated in FIG. 4. It is appreciated that protected item 410 may be visually obscured by elements of unitized packaging suspension system 300. Exemplary folded unitized packaging suspension system 300 with enclosed item 410 may then be placed in a shipping box 420, formed of any suitable material, e.g., corrugated cardboard.

Exemplary folded unitized packaging suspension system 300 with enclosed item 410 is configured to fit snugly within shipping box 420. For example, the exterior dimensions of exemplary folded unitized packaging suspension system 300 may be substantially the same as corresponding interior dimensions of shipping box 420. It is not required that protected item 410, void 310 (FIG. 3), the outer dimensions of exemplary folded unitized packaging suspension system 300, or shipping box 420 be cubical. For example, the length, width, and/or height of such volumes need not be the same.

As previously presented, the "tops" and "bottoms" of the instances 100A, 100B, 100C, 100D, 100E, and 100F (FIG. 1A) may have different shapes and/or dimensions. For example, different size and/or shapes of the "tops" of instances 100A, 100B, 100C, 100D, 100E, and 100F may accommodate a non-cubical protected item 410, e.g., non-regular parallelepipeds. For example, different size and/or shapes of the "bottoms" of instances 100A, 100B, 100C, 100D, 100E, and 100F may fit in non-cubical, e.g., "rectangular," shipping boxes, e.g., shipping box 420.

Figure 5:
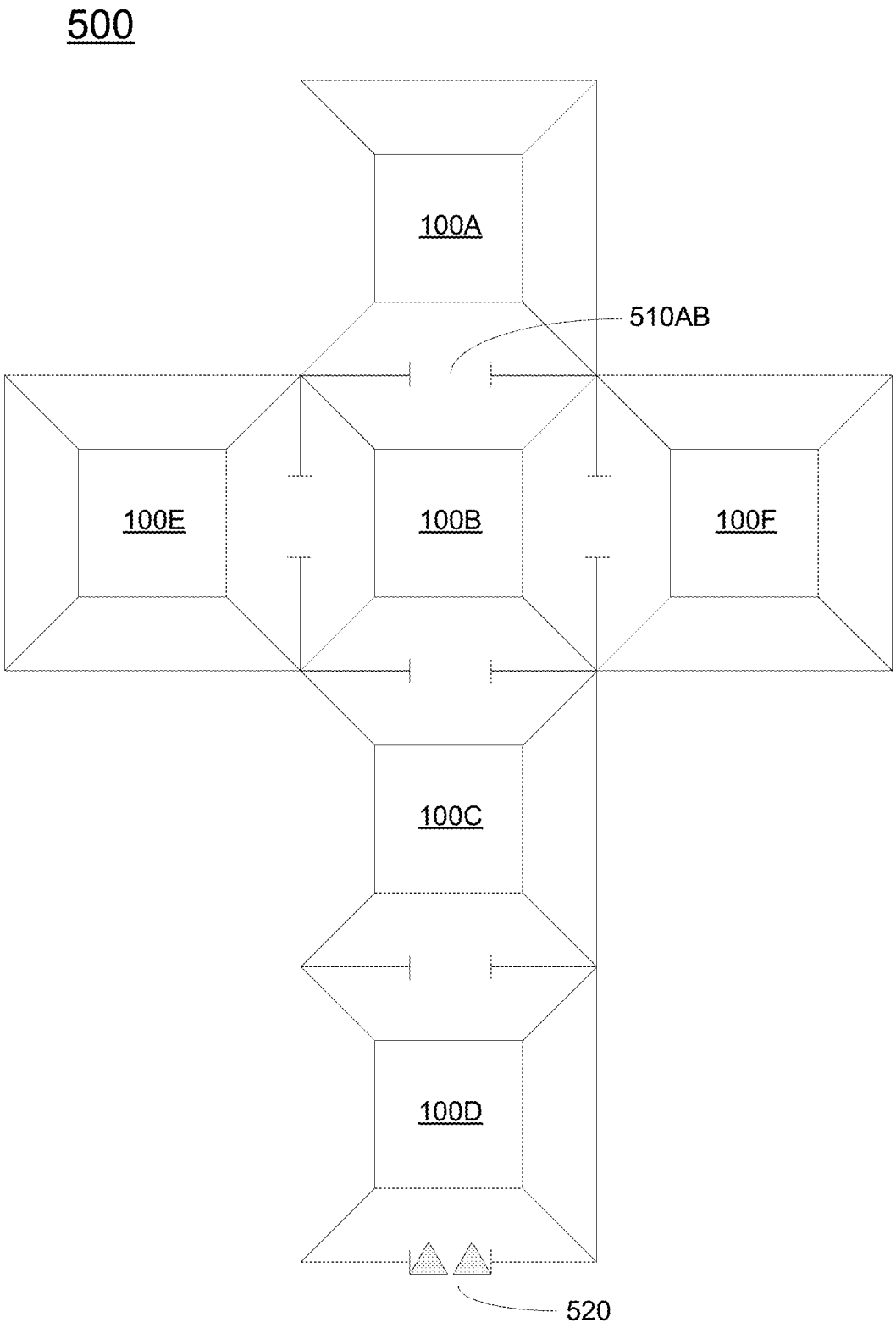
FIG. 5 illustrates an exemplary schematic plan view of an exemplary fluid cushion embodiment of a unitized packaging suspension system, in accordance with embodiments of the present invention.

FIG. 5 illustrates an exemplary schematic plan view of an exemplary fluid cushion embodiment 500 of a unitized packaging suspension system, in accordance with embodiments of the present invention. In contrast to conventional air cushion bags, adjacent chambers, e.g., chambers 100A and 100B, are not sealed from one another. Rather, in accordance with embodiments of the present invention, some or all such adjacent chambers have an opening, therebetween to communicate an inflation fluid, e.g., a gas or liquid, from one chamber to another. For example, opening

510AB interrupts a seal between chambers 100A and 100B, allowing an inflation fluid to flow between chambers 100A and 100B.

Under the conventional art, each chamber, e.g., chambers 100A, 100B, 100C, 100D, 100E, and 100F, are sealed from one another. For example, each of chambers 100A, 100B, 100C, 100D, 100E, and 100F comprise an inflation gas volume that separate and distinct from the gas in the other chambers, e.g., a gas volume in one chamber does not communicate with, or flow between other chambers. Final assembly of such conventional air cushions typically comprises inflating a bag and sealing an inflation port, as an inflation nozzle is removed. For example, uninflated pillow film materials are inflated and sealed by a "pillow inflating machine" at the time and point of use. Conventionally, a continuous strip of single pillows is formed, and a desired number of pillows may be separated from the strip to provide cushioning within a shipping box.

In contrast, in accordance with embodiments of the present invention, exemplary fluid cushion embodiment 500 of a unitized packaging suspension system comprises a single inflation port 520. Inflation port 520 may be located in any suitable location, for example, in any face or any side of any unit or chamber of exemplary fluid cushion embodiment 500.

In accordance with embodiments of the present invention, all chambers may be inflated from a single inflation port, e.g., inflation port 520, in a single operation. For example, air introduced to chamber 100D via inflation port 520 may flow into chamber 100C, and then into chamber 100B, etc. This inflation technique may be understood as "series" inflation of multiple chambers. For example, air introduced to chamber 100D via inflation port 520 may flow into chamber 100C, and then into chamber 100B, etc., in series. It is to be appreciated that an inflation fluid does not flow into the various chambers in parallel, e.g., through a distribution manifold. In this novel manner, only a single inflation and/or sealing operation is required at the point of use, in contrast to multiple such operations required under the conventional art.

In addition embodiments of the present invention may be inflated in the shipping box. For example, under the conventional art, a strip of air pillows, e.g., a single line of individually-inflated air pillows, may be inflated and sealed. Such a strip of pillows is separated into one or a few pillows, and placed into a shipping box, e.g., around an item to be protected. In accordance with embodiments of the present invention, an uninflated unitized packaging suspension system, e.g., system 500, may be placed in the shipping box, e.g., box 420 (FIG. 4), along with protected item 410 (FIG. 4). Unitized packaging suspension system 500 may subsequently be inflated within the shipping box. Advantageously, inflation in the shipping box will tend to self-center protected item 410.

In this novel manner, the number and character of packing an item for shipment are simplified and reduced. For example, under the conventional art, a packer typically accesses a strip of individual air pillows and separates a desired number of pillows from the strip. Some pillows are placed in an empty shipping box, intended to cushion the bottom of a protected item. The protected item may fall off of such pillows, complicating the operation. Subsequently, additional pillows are separated and placed on the sides and top of the protected item, in multiple, e.g., five, additional sequences. This conventional-art operation is subject to human variability, e.g., in the placement, orientation, and/or number of pillows placed on the six sides of the protected item. Such undesirable variation leads to unwanted variation in cost, insufficient and varying levels of shock protection, including deleterious anisotropic variations in shock protection, and deleterious variation in packaged shipping weight. It is to be appreciated that many assembly operations weigh final packaging to determine if all components have been included. Variations in shipping weight due to varying amounts of packaging material may wreak havoc on such weight-based inspections.

In contrast, in accordance with the present invention, a shipper may place an uninflated unitized packaging suspension system 500 into the shipping box 420. Subsequently, protected item 410 is place in shipping box 420, e.g., on face 100B. Unitized packaging suspension system 500 may then be inflated, e.g., via inflation port 520, forming a superior protective structure around protected item 410 in fewer operations. Embodiments in accordance with the present invention possess beneficially more uniform and consistent shock protection characteristics, promote consistent weight, and reduce human packaging errors. Packaging using embodiments of the present invention that are inflated in a shipping box may be automated, which is generally considered commercially infeasible using conventional, single-bag air pillows.

Further, the fluid communication openings, e.g., 510AB, allow for movement of an inflation fluid between chambers after inflation, e.g., in response to a physical shock. Such fluid movement may improve shock absorption characteristics of exemplary fluid cushion embodiment 500, in comparison to a cushioning system employing conventional, single air cushion bags.

Figure 6:
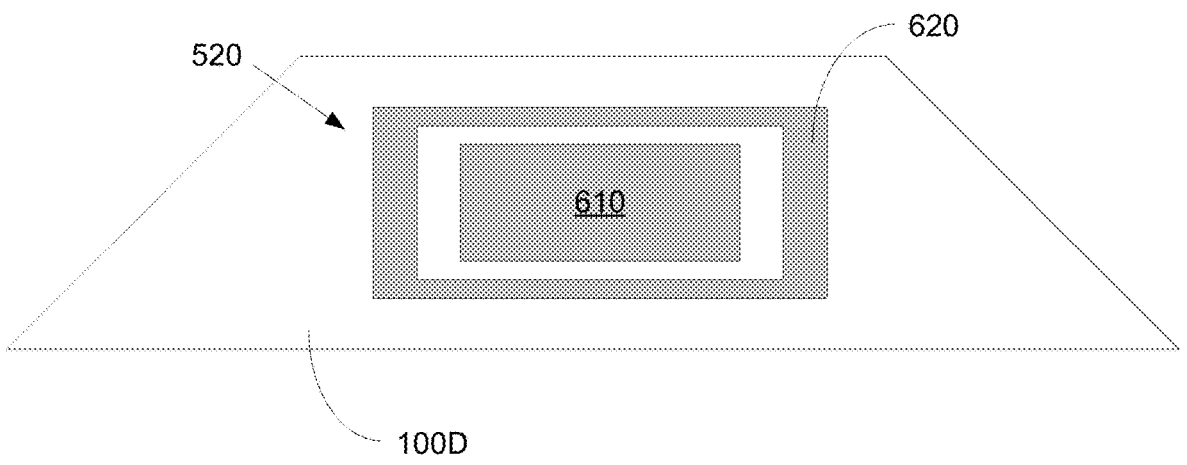
FIG. 6 illustrates an exemplary schematic side view of a unit of an exemplary unitized packaging suspension system, in accordance with embodiments of the present invention.

FIG. 6 illustrates an exemplary schematic side view 600 of a unit of an exemplary unitized packaging suspension system, in accordance with embodiments of the present invention. The unit illustrated may be, for example, unit 100D, as illustrated in FIG. 5. Unit or chamber 100D comprises an inflation port 520, for example, as illustrated in FIG. 5. As illustrated in the embodiment of FIG. 6, inflation port 520 is located in one of the sides of unit or chamber 100D. Inflation port 520 may also be located in a "top" or "bottom" face of a unit or chamber.

Inflation port 520 may comprise an opening 610, though which an inflation fluid, e.g., air, is introduced into chamber 100D. Inflation port 520 may further comprise an inflation port coupling ring 620. Inflation port coupling ring 620 comprises magnetic materials, for example, magnetic materials within a rubber and/or elastomeric material. Inflation port coupling ring 620 is configured to magnetically couple with a similarly shaped magnetic ring that is a part of an inflation apparatus (not shown). Inflation port coupling ring 620 is configured to hold chamber 100D in place, e.g., against an inflation apparatus, during inflation. Inflation port coupling ring 620 is configured to limit escape of an inflation fluid while attached to an inflation apparatus, e.g., during inflation and/or sealing. Inflation port coupling ring 620 may also facilitate sealing of opening 610 by the inflation apparatus, e.g., after inflation.

Inflation port coupling ring 620 may take any suitable shape, for example, a flat torus comprising concentric ellipses, e.g., circles, concentric polygons, and the like.

It is to be appreciated that the novel inflation port coupling ring 620 may be utilized with any inflatable pillow cushion, e.g., single pillows, and is not limited in application to systems of multiple pillows, or systems having inflation communication among multiple pillows.

Figure 7:
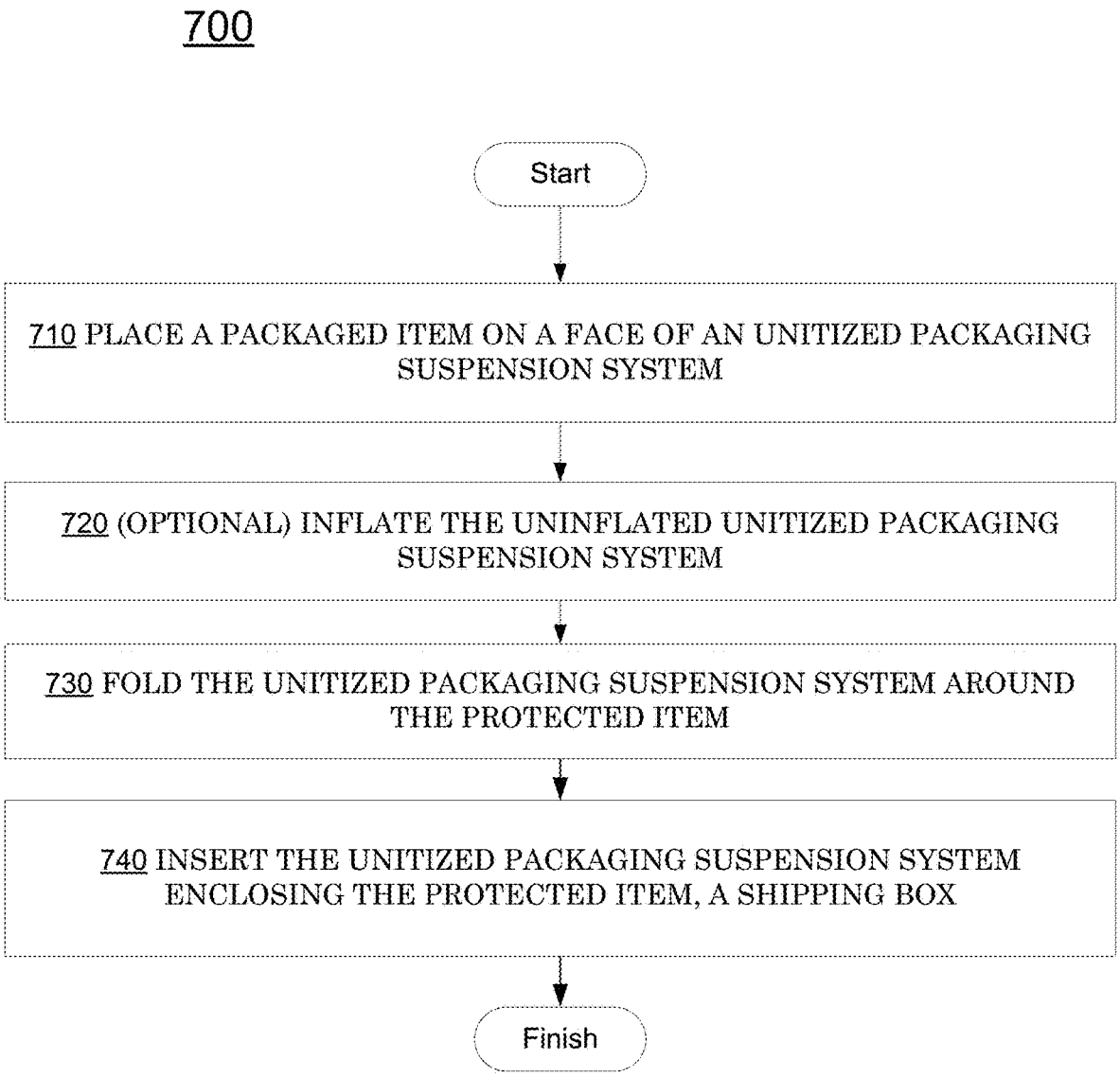
FIG. 7 illustrates a method, in accordance with embodiments of the present invention.

FIG. 7 illustrates a method 700, in accordance with embodiments of the present invention. In 710, a protected item, e.g., protected item 410 (FIG. 4), is placed on a face, e.g., face 100B (FIG. 5), of an unitized packaging suspension system, e.g., unitized packaging suspension system 500 (FIG. 5). In accordance with the present method embodiment, a unitized packaging suspension system may be constructed from any suitable material, and is not limited to embodiments that may be inflated. In accordance with embodiments of the present invention, inflatable embodiments of a unitized packaging suspension system may be either inflated or uninflated when a protected item is placed on a face of the unitized packaging suspension system.

In optional 720, the unitized packaging suspension system is inflated. In 730, the unitized packaging suspension system is folded around the protected item, for example, as illustrated by item 300 in FIG. 4.

In 740, the unitized packaging suspension system enclosing the protected item is inserted into a shipping box, for example, as illustrated in FIG. 4.

Figure 8:
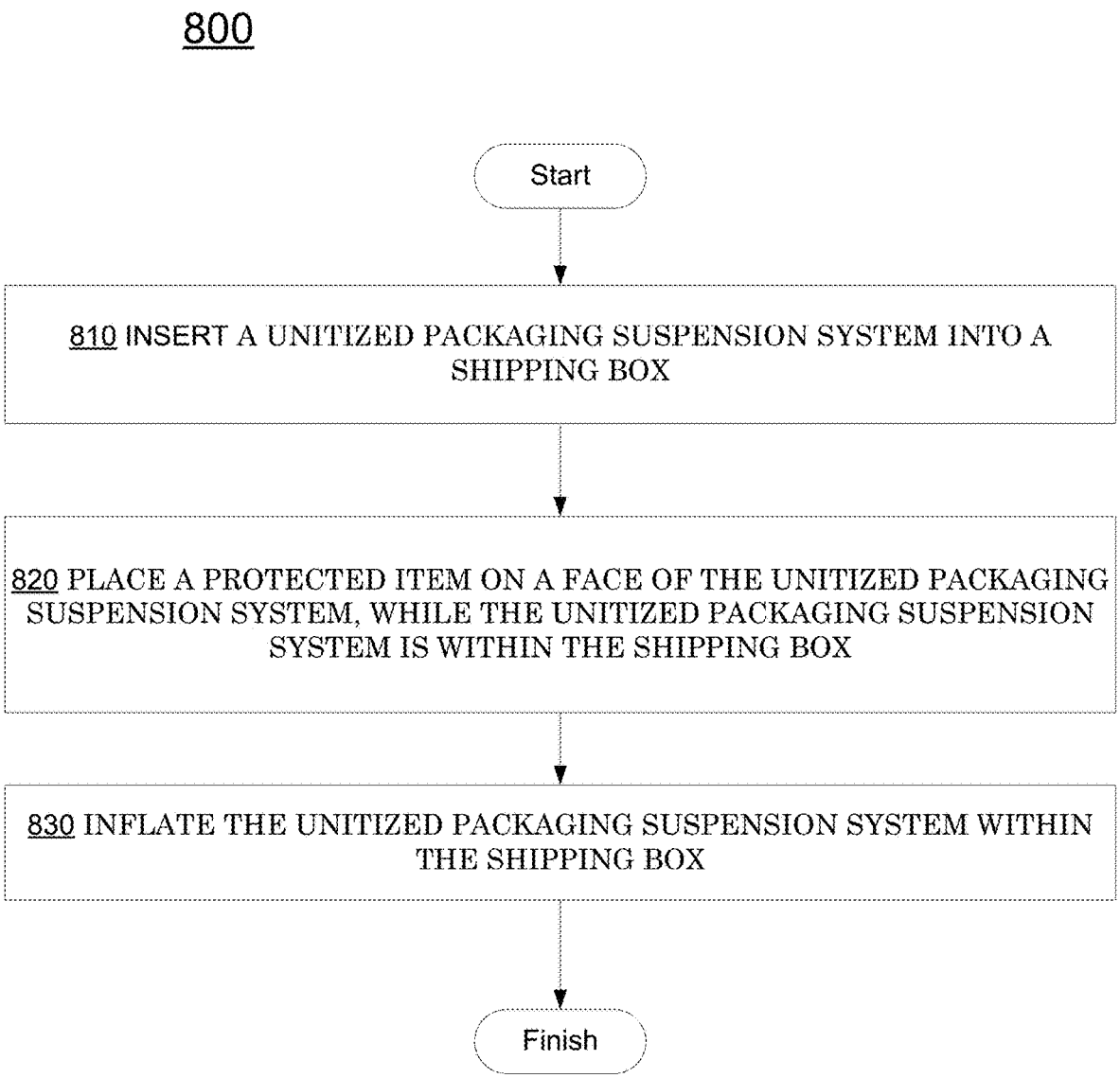
FIG. 8 illustrates a method, in accordance with embodiments of the present invention.

FIG. 8 illustrates a method 800, in accordance with embodiments of the present invention. In 810, a unitized packaging suspension system, e.g., unitized packaging suspension system 500 as illustrated in FIG. 5, is inserted into a shipping box. In 820, a protected item, e.g., protected item 410 (FIG. 4) is placed on a face, e.g., face 100B (FIG. 5), of the unitized packaging suspension system, e.g., while the unitized packaging suspension system is within the shipping box.

In 830, the unitized packaging suspension system is inflated within the shipping box. In this novel manner, the unitized packaging suspension system provides a reduced packaging parts count, and reduces operations during packaging.

Embodiments in accordance with the present invention provide systems and methods for unitized packaging suspension systems. Additionally embodiments in accordance with the present invention provide systems and methods for unitized packaging suspension systems that improve shock protection for a packaged item. Further, embodiments in accordance with the present invention provide systems and methods for unitized packaging suspension systems that reduce packaging parts counts and manual packaging operations. Still further, embodiments in accordance with the present invention provide systems and methods for unitized packaging suspension systems that are compatible and complementary with existing systems and methods of packaging and shipping.

Various embodiments of the invention are thus described. While the present invention has been described in particular embodiments, it should be appreciated that the invention should not be construed as limited by such embodiments, but rather construed according to the below claims.

What is claimed is:

1. A shipping system comprising:
an exterior shipping container;
an interior package box;
a cushioning apparatus, separate from said exterior container, configured to be placed inside of said shipping container, between an interior of said shipping container and said interior package box, said cushioning apparatus comprising:
a plurality of inflation chambers, wherein each of said chambers is configured to have a general shape, when inflated, of a truncated rectangular pyramid,
wherein each of said plurality of inflation chambers is foldably coupled to another of said plurality of inflation chambers at an edge of said inflation chamber,
wherein said cushioning apparatus is characterized as having a cruciform shape, and
wherein said plurality of inflation chambers, when inflated, are configured to be folded into a shape that surrounds said interior package box between said plurality of inflation chambers.

2. The cushioning apparatus of claim 1 wherein said interior package box is surrounded on six sides.

3. The cushioning apparatus of claim 1 comprising six inflation chambers.

4. The cushioning apparatus of claim 1 wherein said interior package box comprises a parallelepiped shape.

5. The cushioning apparatus of claim 1 configured so that an inflation fluid may be communicated among at least two of said plurality of inflation chambers.

6. The cushioning apparatus of claim 5 configured so that all of said plurality of inflation chambers may be inflated by a single coupling to an inflation apparatus.

7. The cushioning apparatus of claim 1 further comprising an inflation port coupling ring, configured to magnetically hold one of said plurality of inflation chambers to an inflating apparatus.

8. A shipping system comprising:
a shipping container;
a package box;
a cushioning apparatus configured to be placed inside of said shipping container, comprising:
a plurality of truncated rectangular pyramids formed from sheet material,
wherein each of said truncated rectangular pyramids is foldably coupled to another of said plurality of truncated rectangular pyramids at an edge,
wherein said cushioning apparatus is characterized as having a cruciform shape, and
wherein said plurality of truncated rectangular pyramids are configured to be folded into a shape that defines a bounded void in three dimensions disposed between said plurality of truncated rectangular pyramids,
wherein said void is configured to contain said package box.

9. The cushioning apparatus of claim 8 wherein said void is surrounded on six sides.

10. The cushioning apparatus of claim 8 comprising six truncated rectangular pyramids.

11. The cushioning apparatus of claim 8 wherein said void is configured to accommodate a cubical protected item.

12. The cushioning apparatus of claim 8 wherein said void is configured to accommodate a non-cubical protected item.

13. The cushioning apparatus of claim 8 wherein at least one of said plurality of truncated rectangular pyramids comprises a non-square base.

14. The cushioning apparatus of claim 8 wherein at least one of said plurality of truncated rectangular pyramids comprises a base that is a different shape from a base of another of said plurality of truncated rectangular pyramids.

15. A shipping system comprising:
an exterior shipping box;
an interior package box;
a unitized packaging suspension system removably inserted into said shipping box, said packaging system comprising:
a plurality of inflated air pillows, wherein each of said air pillows is characterized as having a general shape of a truncated rectangular pyramid,
wherein each of said plurality of air pillows is foldably coupled to another of said plurality of air pillows at an edge of said air pillows, wherein said plurality of air pillows are folded into a shape that surrounds a void between said plurality of inflation chambers; and a protected item encapsulated within said interior package box.

16. The shipping box of claim 15 comprising six air pillows.

17. The shipping box of claim 15 wherein all of said plurality of inflated air pillows are configured to communicate an inflation gas between adjacent air pillows.

* * * * *